US006776385B1

(12) United States Patent
Chang

(10) Patent No.: US 6,776,385 B1
(45) Date of Patent: Aug. 17, 2004

(54) ADJUSTABLE BOOK HOLDER

(76) Inventor: Chun Yuan Chang, P.O.Box 63-99, Taichung (TW)

( * ) Notice: Subject to any disclaimer, the term of this patent is extended or adjusted under 35 U.S.C. 154(b) by 0 days.

(21) Appl. No.: 10/424,187

(22) Filed: Apr. 23, 2003

(51) Int. Cl.[7] ..... A47B 97/04
(52) U.S. Cl. ..... 248/448; 248/460; 248/910
(58) Field of Search ..... 40/400–403; 248/910, 248/448, 447, 458, 460, 457, 292.12

(56) References Cited

U.S. PATENT DOCUMENTS

| | | | | | |
|---|---|---|---|---|---|
| 1,184,246 | A | * | 5/1916 | Klein | 248/448 |
| 1,627,133 | A | * | 5/1927 | Ailes | 248/460 |
| 2,572,731 | A | * | 10/1951 | Keith | 248/457 |
| 2,583,097 | A | * | 1/1952 | Heimann | 248/456 |
| 2,617,219 | A | * | 11/1952 | Conley et al. | 40/400 |
| 2,743,550 | A | * | 5/1956 | Felice | 248/457 |
| 2,959,877 | A | * | 11/1960 | Deinlein | 40/400 |
| 3,999,734 | A | * | 12/1976 | Gibson et al. | 248/460 |
| 4,066,168 | A | | 1/1978 | O'Toole et al. | 211/4 |
| 4,116,413 | A | * | 9/1978 | Andersen | 248/451 |
| 4,269,381 | A | | 5/1981 | Harms | 248/222.2 |
| 5,415,372 | A | * | 5/1995 | Shepherd et al. | 248/447 |
| 5,547,305 | A | * | 8/1996 | Treche | 403/97 |
| 6,000,663 | A | * | 12/1999 | Plasse et al. | 248/27.8 |
| 6,131,872 | A | * | 10/2000 | Ford | 248/453 |
| 6,202,973 | B1 | * | 3/2001 | Navarin et al. | 248/444 |
| 6,457,591 | B1 | * | 10/2002 | Lee | 211/41.2 |
| 6,547,202 | B2 | * | 4/2003 | Paton | 248/453 |

* cited by examiner

*Primary Examiner*—Korie Chan

(57) ABSTRACT

A book holder includes a bracket rotatably and adjustably secured to a base with one or more fasteners and/or with a serrated surface or a number of teeth. A casing includes a pedestal secured to the bracket, to allow the casing to be adjustably secured to the base at selected angular position by the bracket, and to support documents at the selected angular position relative to the base and to the readers. The base may include one or more weights to increase a stability of the base. The casing includes two end fences each having a number of apertures to rotatably receive pins of plates, and to rotatably secure the plates to the casing.

7 Claims, 5 Drawing Sheets

ADJUSTABLE BOOK HOLDER

BACKGROUND OF THE INVENTION

1. Field of the Invention

The present invention relates to a book holder, and more particularly to an adjustable book holder for adjusting and holding books or documents at selected or suitable angular positions relative to the supporting tables or surfaces.

2. Description of the Prior Art

Typical book holders normally comprise a solid structure that may only be used to hold the books or documents or the like, and that may not be adjusted to different angular positions relative to the supporting tables or surfaces.

U.S. Pat. No. 4,269,381 to Harms discloses one of the typical book holders comprising a holder member for hanging onto supporting objects. However, once the holder members have been attached or hung onto the supporting objects, the holder members may no longer be adjusted relative to the supporting objects, such that the books or documents also may not be adjusted to different angular positions relative to the supporting tables or surfaces or relative to the readers.

U.S. Pat. No. 4,066,168 to O'Toole et al. discloses another typical book holder comprising a holder plate or board which may be supported at a predetermined inclined position relative to the supporting tables or surfaces with a removable leg unit. However, the leg unit may only be secured to the holder plate or board at a predetermined inclined position relative to the supporting tables or surfaces, and also may not be adjusted to different angular positions relative to the supporting tables or surfaces or relative to the readers.

The present invention has arisen to mitigate and/or obviate the afore-described disadvantages of the conventional book holders.

SUMMARY OF THE INVENTION

The primary objective of the present invention is to provide an adjustable book holder for adjusting and holding books or documents at selected or suitable angular positions relative to the supporting tables or surfaces or relative to the readers.

In accordance with one aspect of the invention, there is provided a book holder comprising a base, a bracket rotatably attached to the base, at least one fastener engaged with the bracket and the base, to adjustably secure the bracket to the base at selected angular position, and a casing including a pedestal secured to the bracket, to allow the casing to be adjustably secured to the base at selected angular position by the bracket, and to support documents at the selected angular position relative to the base.

The base includes a recess formed therein and defined by a front wall and two side walls, and each of the side walls of the base includes a screw hole formed therein to thread with the fastener.

A first side wall of the side walls of the base includes a plurality of teeth provided around the screw hole thereof to engage with the bracket, and to adjustably support the bracket relative to the base at the selected angular position. The bracket includes a first end having a plurality of teeth provided thereon to engage with the base, and to adjustably support the bracket relative to the base at the selected angular position.

The front wall of the base includes a stop extended therefrom to engage with and to support the documents at the selected angular position relative to the base. The base includes at least one weight received and secured therein to increase a stability of the base.

The pedestal of the casing including a cavity formed therein, the bracket includes a panel extended therefrom and engaged into the cavity of the pedestal of the casing, and secured to the pedestal of the casing with a fastener.

The casing includes two end fences each having a plurality of apertures formed therein, and at least one plate having at least one pin extended therefrom and engaged into either of the apertures of the casing, to rotatably secure the plate to the casing.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
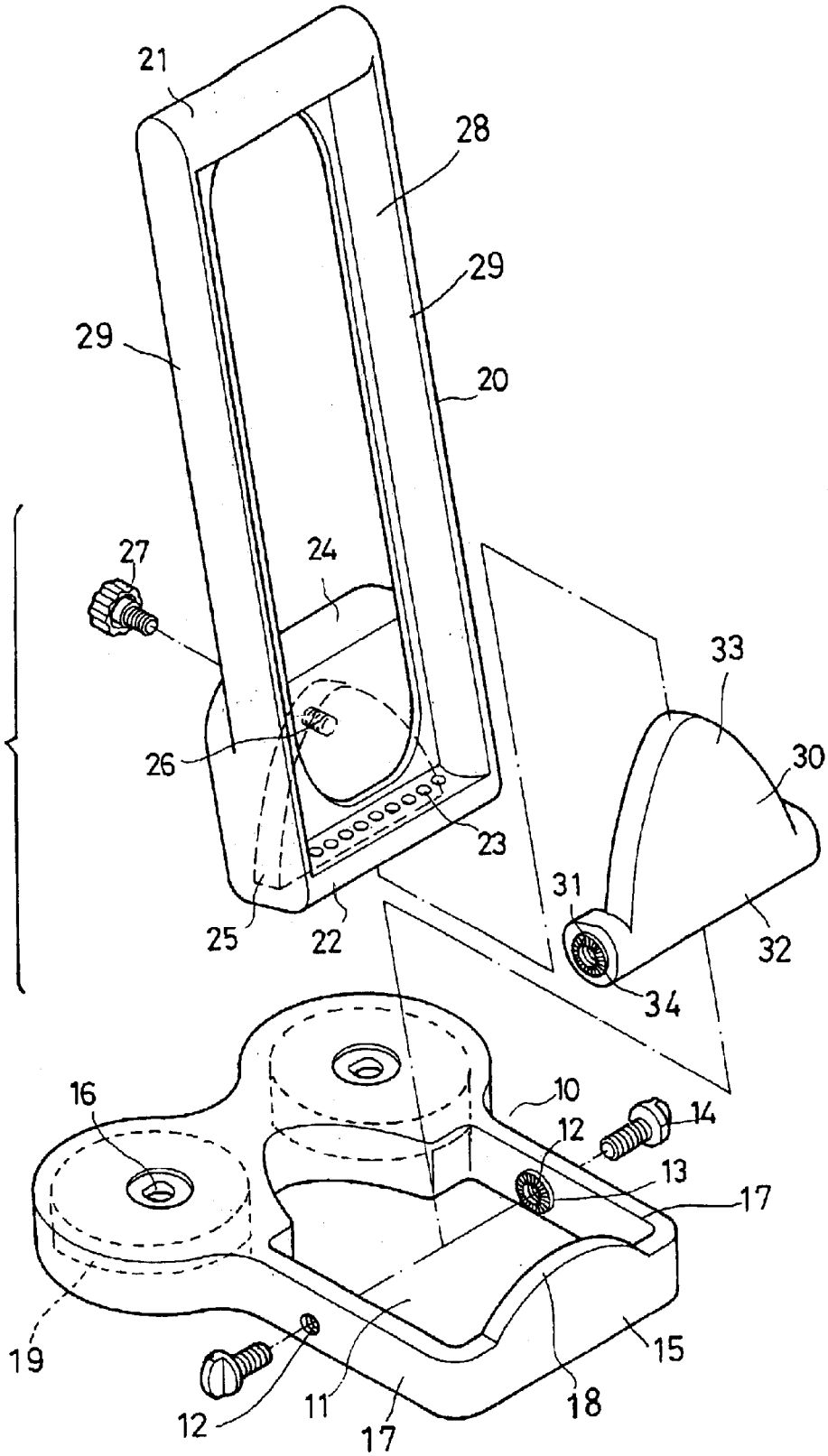
FIG. 1 is an exploded view of a book holder in accordance with the present invention.
Figure 2:
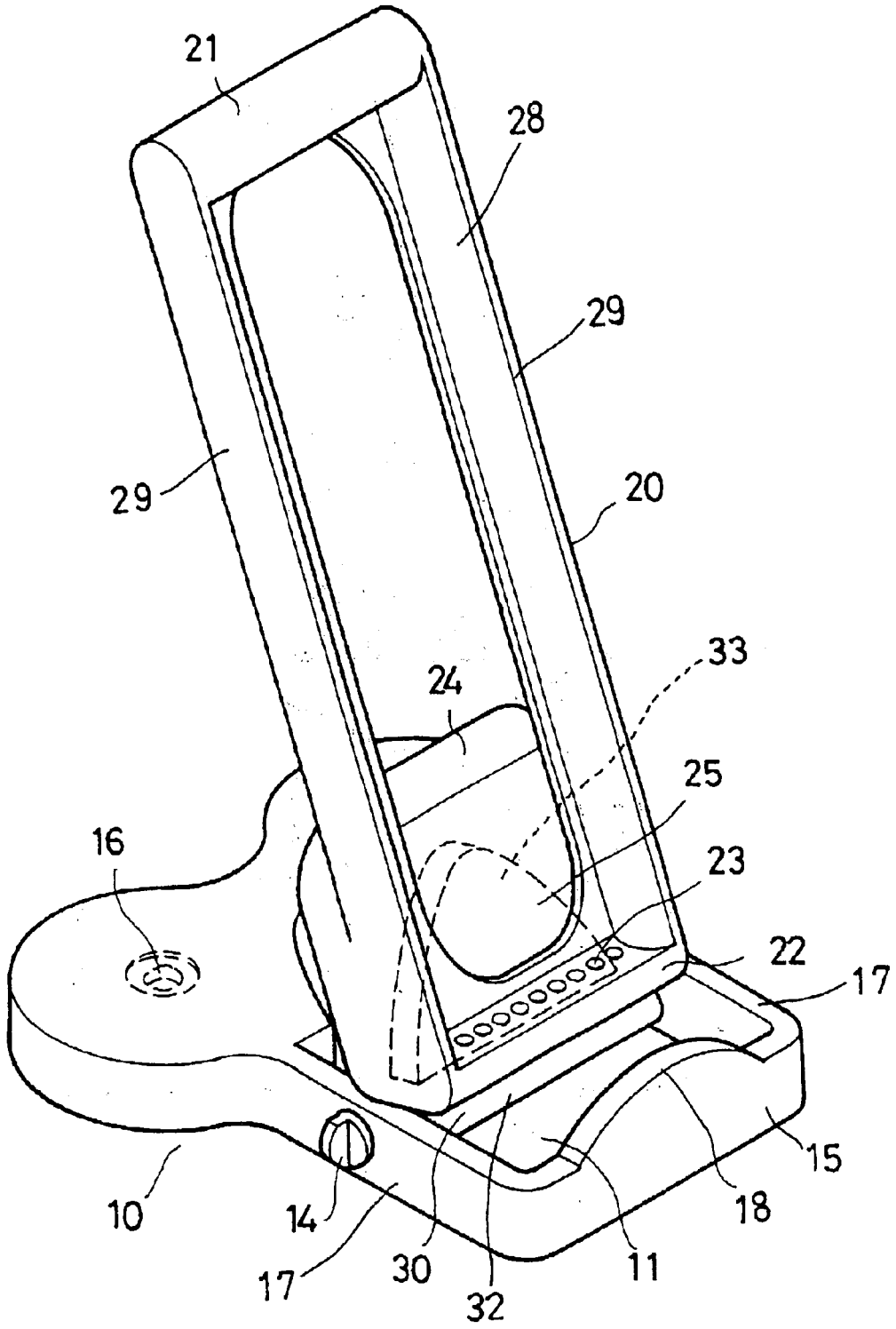
FIG. 2 is a perspective view of the book holder.

Referring to the drawings, and initially to FIGS. 1 and 2, a book holder in accordance with the present invention comprises a base 10 including a recess 11 formed therein and defined by a front wall 15 and two side walls 17, and including a pair of screw holes 12 formed in the side walls 17 respectively to thread with fasteners 14.

The base 10 preferably includes one or more holes 16 formed therein for receiving fasteners (not shown) which may solidly secure the base 10 to various supporting tables or surfaces, and preferably includes one or more weights 19 (FIG. 1) received and secured therein for increasing the stability of the base 10, and for stably supporting books, plates 40 (FIGS. 3, 4) or documents or the like on the base 10.

The front wall 15 preferably includes a bulge or stop 18 extended upwardly therefrom to engage with books 50 (FIG. 5) or documents or the like, and thus for further stably supporting books, plates 40 (FIG. 5) or documents or the like on the base 10. The base 10 preferably includes a serrated surface or a number of teeth 13 formed and provided around the screw hole 12 of each of the side walls 17.

A bracket 30 includes one or more, such as two screw holes 31 formed in the ends of a seat 32, and aligned with the screw holes 12 of the base 10, for threading with the fasteners 14 which may secure the bracket 30 to the base 10 at any selected or suitable angular positions and which may form a pivot axle that rotatably secures the bracket 30 to the base 10.

The bracket 30 includes a panel 33 extended from the seat 32. The bracket 30 preferably includes a serrated surface or a number of teeth 34 formed and provided around each of the screw holes 31 thereof, to engage with the corresponding serrated surface or teeth 13 of the side walls 17, and thus to adjustably and solidly secure the bracket 30 to the side walls 17 of the base 10 at any selected or suitable angular positions.

A frame or casing 20 includes a pedestal 24 having a cavity 25 formed therein to receive the panel 33 of the bracket 30, and having a screw hole 26 formed therein to receive a fastener 27 which may secure the pedestal 24 of the casing 20 to the bracket 30. The casing 20 may thus also be adjusted relative to the base 10 at any selected or suitable angular positions by the bracket 30.

The casing 20 includes a chamber 28 formed therein and defined by two side fences 29 and two end fences 21, 22. The end fences 21, 22 each may include a number of apertures 23 formed therein. The plates 40 may each include one or more pivot pins 41 extended therefrom and engaged into the apertures 23 of the casing 20, to rotatably secure the plates 40 to the casing 20, and to support documents on the plates 40.

Figure 3:
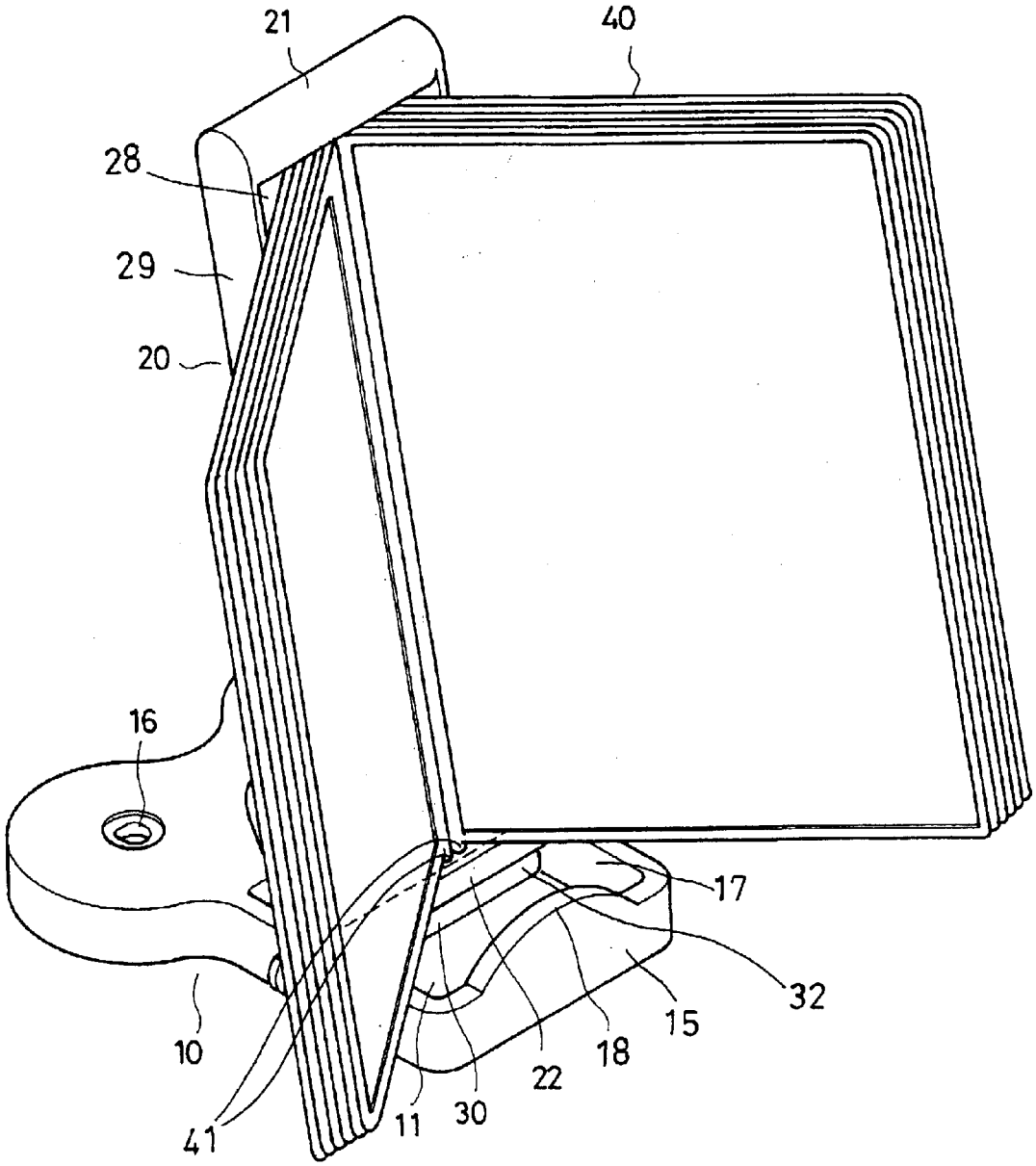
FIGS. 3, 4, 5 are perspective views illustrating the operation of the book holder.
Figure 4:
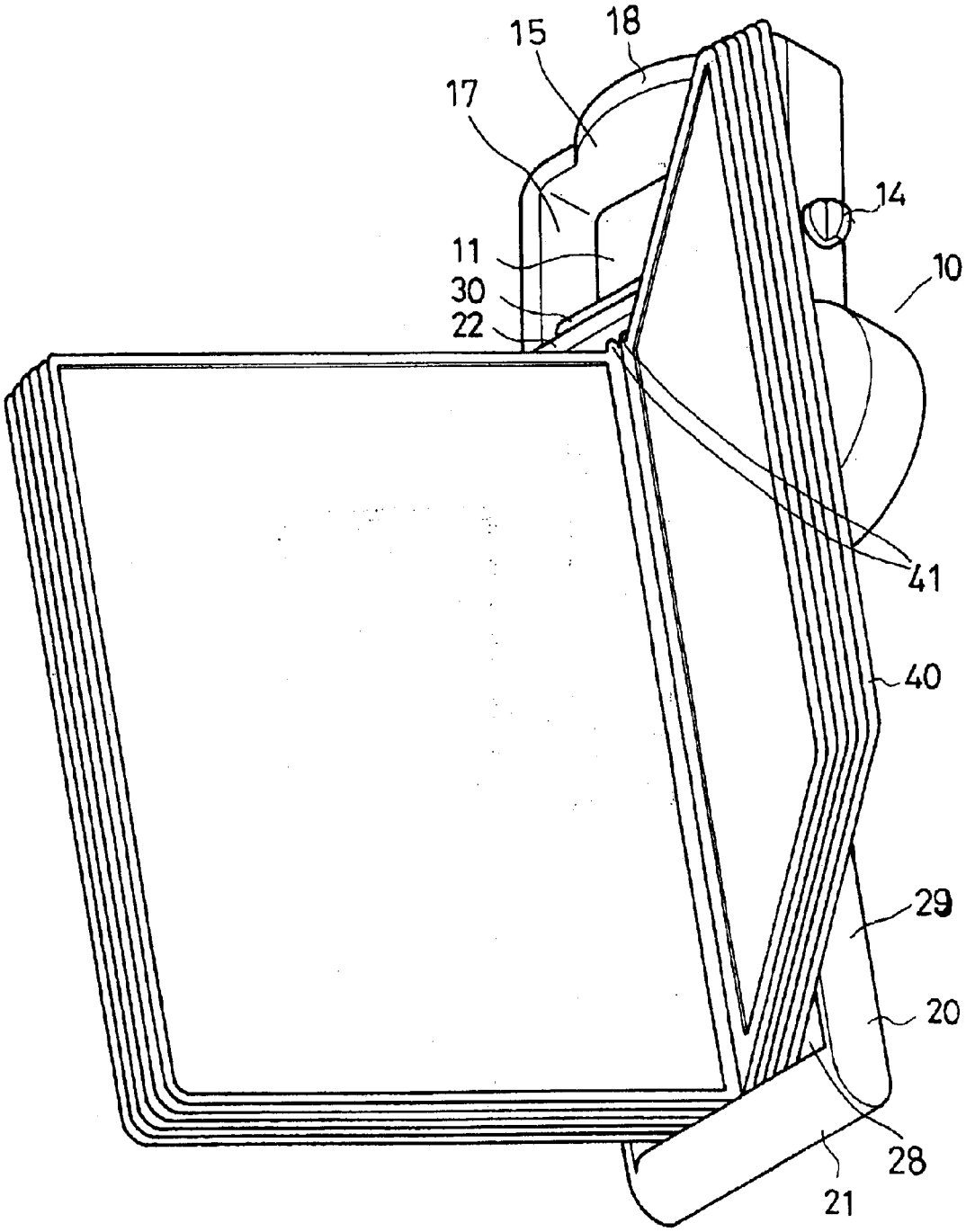

In operation, as shown in FIGS. 3 and 4, the casing 20 may be adjusted relative to the base 10 to any selected or suitable angular positions by the bracket 30, in order to suitably support the plates 40, or the books, or the documents or the like at any selected or suitable angular positions relative to the supporting tables or surfaces and the readers.

Figure 5:
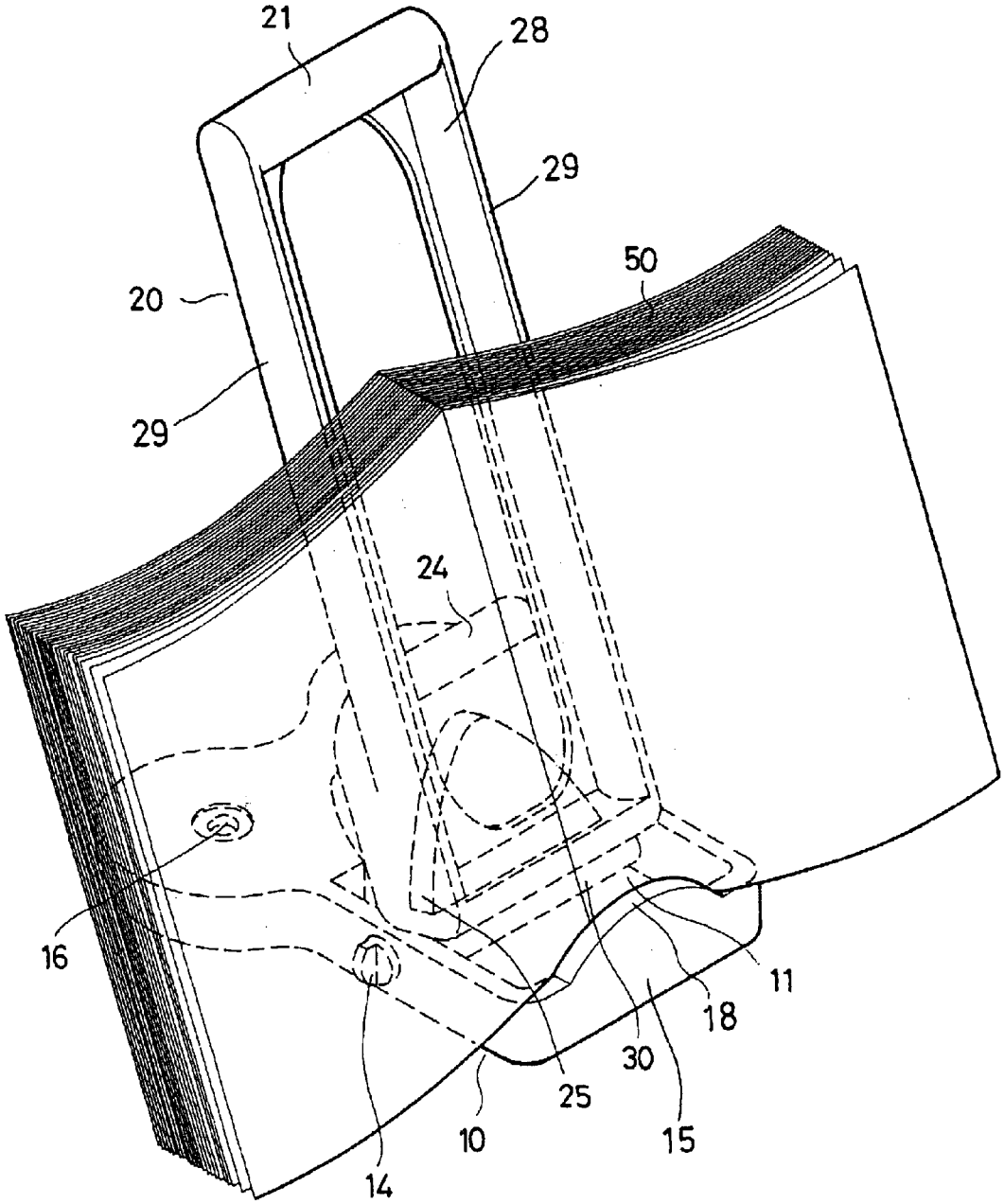

As shown in FIG. 5, the books 50 or documents or the like may also be seated or rested on the casing 20, and may have their lower portion partially and stably received in the recess 11 of the base 10, and may further be stably retained in the erect or inclined position relative to the base 10 by the bulge or stop 18 of the front wall 15 of the base 10.

Accordingly, the book holder in accordance with the present invention may be provided and used for adjusting and holding books or documents at selected or suitable angular positions relative to the supporting tables or surfaces or relative to the readers.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A book holder comprising:

a base, a bracket rotatably attached to said base, at least one fastener engaged with said bracket and said base, to adjustably secure said bracket to said base at selected angular position, and a casing including a pedestal secured to said bracket, to allow said casing to be adjustably secured to said base at selected angular position by said bracket, and to support documents at the selected angular position relative to said base, said casing including two end fences each having a plurality of apertures formed therein, and at least one plate having at least one pin extended therefrom and engaged into either of said apertures of said casing, to rotatable secure said at least one plate to said casing.

2. The book holder according to claim 1, wherein said base includes a recess formed therein and defined by a front wall and two side walls, and each of said side walls of said base includes a screw hole formed therein to thread with said at least one fastener.

3. The book holder according to claim 2, wherein a first side wall of said side walls of said base includes a plurality of teeth provided around said screw hole thereof to engage with said bracket, and to adjustably support said bracket relative to said base at the selected angular position.

4. The book holder according to claim 2, wherein said bracket includes a first end having a plurality of teeth provided thereon to engage with said base, and to adjustably support said bracket relative to said base at the selected angular position.

5. The book holder according to claim 1, wherein said pedestal of said casing includes a cavity formed therein, said bracket includes a panel extended therefrom and engaged into said cavity of said pedestal of said casing, and secured to said pedestal of said casing with a fastener.

6. The book holder according to claim 1, wherein said base includes at least one weight received and secured therein to increase a stability of said base.

7. A book holder comprising:

a base including a recess formed therein and defined by a front wall and two side walls, and each of said side walls of said base including a screw hole formed therein, said front wall of said base including a stop extended therefrom to engage with documents, a bracket rotatably attached to said base, at least one fastener threaded with said screw hole of either of said side walls of said base, and engaged with said bracket, to adjustable secure said bracket to said base at selected angular position, and a casing including a pedestal secured to said bracket, to allow said casing to be adjustable secured to said base at selected angular position by said bracket, and to support the documents at the selected angular position relative to said base.

* * * * *